United States Patent [19]

Voigt et al.

[11] Patent Number: 4,726,636

[45] Date of Patent: Feb. 23, 1988

[54] COVER FOR RACK CABINETS, PARTICULARLY FOR DATA PROCESSING EQUIPMENT

[75] Inventors: Ulrich Voigt, Munich; Leopold Hoer, Augsburg; Werner Stoebrich, Biberbach, all of Fed. Rep. of Germany

[73] Assignee: Siemens Aktiengesellschaft, Berlin and Munich, Fed. Rep. of Germany

[21] Appl. No.: 886,959

[22] Filed: Jul. 24, 1986

Related U.S. Application Data

[63] Continuation of Ser. No. 584,928, Feb. 29, 1984, abandoned.

[30] Foreign Application Priority Data

Mar. 22, 1983 [DE] Fed. Rep. of Germany ... 8308532[U]

[51] Int. Cl.[4] ..... A47B 47/03

[52] U.S. Cl. ..... 312/257 SK

[58] Field of Search ..... 312/257 A; 220/4 A, 220/4 R, 4 F

[56] References Cited

U.S. PATENT DOCUMENTS

| | | | |
|---|---|---|---|
| 2,757,059 | 7/1956 | Forrest | 220/4 F |
| 3,365,535 | 1/1968 | Wilk | 312/257 R |
| 3,736,035 | 5/1973 | Brown et al. | 312/111 |
| 4,206,956 | 6/1980 | Lydmar | 312/257 A X |
| 4,428,482 | 1/1984 | Ogawa | 220/340 |
| 4,572,597 | 2/1986 | Voigt et al. | 312/257 A X |

*Primary Examiner*—Joseph Falk

*Attorney, Agent, or Firm*—Hill, Van Santen, Steadman & Simpson

[57] ABSTRACT

A planar cover for rack or upright cabinets having quadrangular hollow tube framing is provided with flanges at three of the sides and a rounded section at its front side carrying a further flange for engaging tabs extending from a front panel or cover of the cabinet.

4 Claims, 3 Drawing Figures

COVER FOR RACK CABINETS, PARTICULARLY FOR DATA PROCESSING EQUIPMENT

This is a continuation of application Ser. No. 584,928, filed Feb. 29, 1984, now abandoned.

CROSS REFERENCE TO RELATED APPLICATION

This application is related to an application Ser. No. 584,895, filed Feb. 29, 1984 now U.S. Pat. No. 4,572,597.

BACKGROUND OF THE INVENTION

1. Field of the Invention

The present invention relates to a planar-designed cover for rack cabinets having quadrangular hollow tube framing, the cover being provided with angled flanges at three of its edges.

2. Description of the Prior Art

In data technology, upright rack-tight cabinets are employed for receiving and housing electrical components, the cabinets generally consisting of quadrangular hollow tube framing that is provided with covers on all sides, whereby the lateral parts are particularly identically designed.

SUMMARY OF THE INVENTION

The object of the present invention is to provide the lateral coverings of devices, particularly devices for remote data processing, with paneling elements that simultaneously assume other functions, such as high frequency (HF) shielding and outer facing.

In order to achieve the above object, the cover of the present invention is designed such that its front side is rounded and is provided with a flange at the rounded end that embraces angled tabs of a front panel and such that fastening devices can be applied to the rear flange.

According to a further feature of the invention, the cover can also be designed such that the upper and lower sides are squared, multiply slotted and slightly prestressed at a distance from an outside quadrangular hollow tube dimension. The front plate can be provided with embossed dimples on its squared elements for the purpose of better contacting. A lateral cover designed in such a manner is particularly suited to hire requirements with respect to HF shielding.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
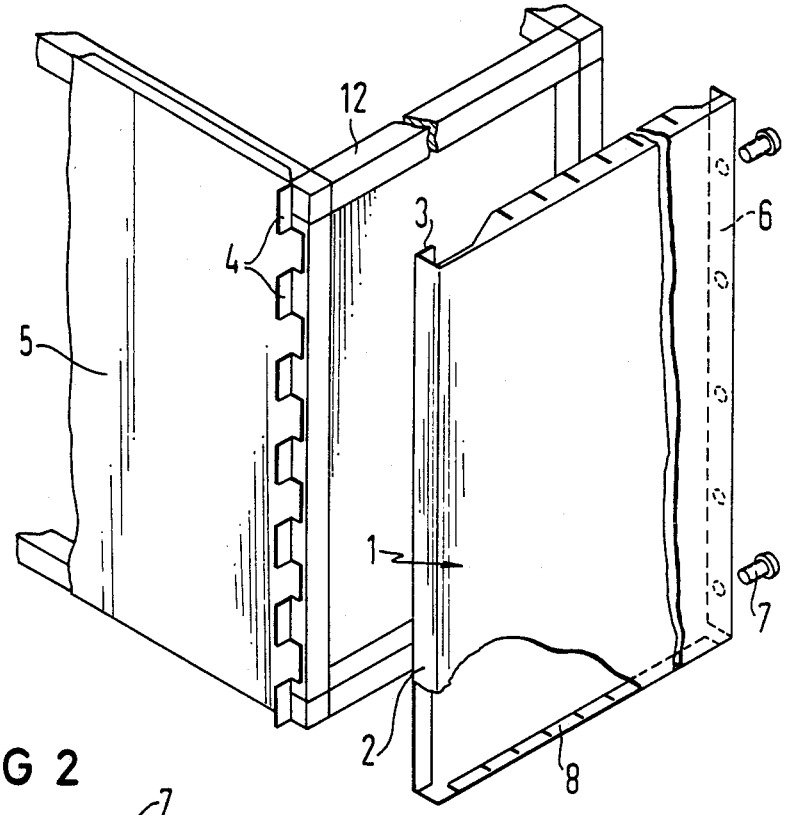
FIG. 1 is a perspective view of a hollow tube frame in which a lateral cover has been applied to one side and removed on the other side.

Referring to FIG. 1, a hollow tube frame that is the core component of the rack cabinet is illustrated, such as is employed for data processing equipment. The frame comprises bonded or screwed quadrangular hollow tubes. Mirror-image, identical covers 1 are applied to the lateral sides, whereas the front side and back side are provided with different covers. The cover at the front side has been omitted for simplicity on the drawing. It essentially comprises a mounting plate and a cover located thereabove. The rear cover is likewise not illustrated.

At its two vertical sides, a mounting plate 5 at the front side is provided with tabs 4 which extend at right angles and which are received by squared flanges 3 at the front end of the lateral covers. After the front flange has been resiliently engaged, the lateral covers are inserted over the capping hollow tubes 12 and screwed thereto with the assistance of screws 7 through the rear flange 6.

Figure 2:
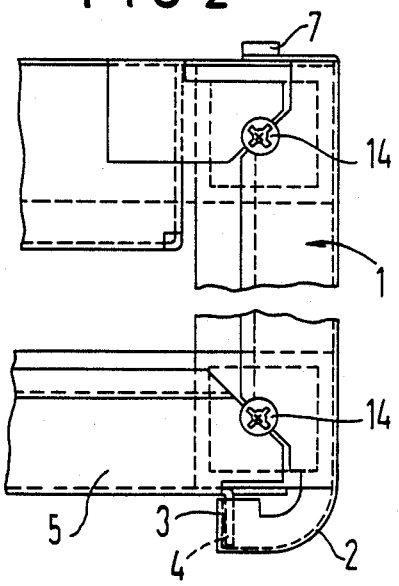
FIG. 2 is a fragmentary top view of the structure of FIG. 1.

The covers are thereby provided with flanges on three sides, with the front side being rounded and provided with a further flange at the end of the rounded section, as best seen in FIG. 2.

Figure 3:
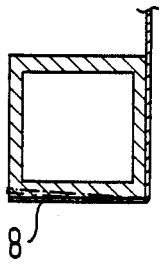
FIG. 3 is a fragmentary sectional view of the structure of FIG. 1 with the cover applied to the frame.

At the upper and lower sides of the cover, the flanges are formed at the distance of the outer dimensions of the hollow tubes, whereby the flange 8 is respectively slotted so that a resilient effect arises. The slotted flanges are slightly pre-stressed, as best seen in FIG. 3. The resilient flanges, which need not be restricted to one side, effect a HF-tight closure so that even higher shielding requirements can be met with this design.

In a plan view, FIG. 2 illustrates greater details of the invention. In FIG. 2 a front mounting plate 5 is illustrated with tabs 4 which are received in engagement with the flange 3 carried by the rounded edge 2 of the cover 1. The mounting plates 5 are attached by way of screws 14, whereas the lateral covers are held, as seen in FIGS. 1 and 2, by the screws 7.

Cabinets constructed in accordance with the present invention take into account cabinet tolerances standard in fabrication of such cabinets.

Although rack or upright cabinet structures have been described in the above-discussed embodiment as having closed quadrangular hollow tube framing, such cabinets can also be manufactured with open profiles or in a self-bearing structure consisting of metal or plastic.

Although we have described our invention by reference to particular illustrative embodiments thereof, many other changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A cover for a quadrangular hollow tube frame of upper, lower, front and rear tubes on a cabinet of a radio frequency sealed cabinet including a mounting plate, comprising:

a plurality of flexible tabs extending from said mounting plate perpendicular to said mounting plate in a row adjacent said front tube of said frame;

a planar cover panel comprising four sides;

a first of said sides including a rounded section and a first flange at the distal end of said rounded section extending parallel to said cover for engaging over said tabs;

second, third and fourth ones of said sides each including a respective flexible flange extending generally perpendicular to said planar cover panel for engaging over said upper, lower and rear tubes causing flexing of said flanges; and fastening means for securing said flange of said fourth side to said rear tube.

2. The structure of claim 1, wherein:

said flanges of said second and third sides are multiply slotted and slightly pre-stressed.

3. A cover for a quadrangular frame of upper, lower, front and rear frame members on a cabinet side of a radio frequency sealed cabinet including a mounting plate, comprising:

a plurality of flexible tabs extending from said mounting plate perpendicular to said mounting plate in a row adjacent said front frame member;

a planar cover panel comprising four sides;

a first of said sides including a rounded section and a first flange at the distal end of said mounted section extending parallel to said cover panel for engaging over said tabs;

second, third and fourth ones of said sides each including a respective flexible flange extending generally perpendicular to said cover panel for engaging over said upper, lower and rear frame members causing flexing of said flanges; and fastening means for securing said flange of said fourth side to said rear frame member.

4. The structure of claim 3, wherein:

said flanges of said second and third sides are multiply slotted and slightly pre-stressed.

* * * * *